United States Patent [19]

Austin, Jr.

[11] 4,071,201

[45] Jan. 31, 1978

[54] REEL FOR TICKET ROLLS

[75] Inventor: Harvey B. Austin, Jr., Berwyn, Pa.

[73] Assignee: Globe Ticket Company, Horsham, Pa.

[21] Appl. No.: 785,024

[22] Filed: Apr. 6, 1977

[51] Int. Cl.[2] ..... B65H 19/00; B65H 35/10

[52] U.S. Cl. ..... 242/55.2; 225/46

[58] Field of Search ..... 242/54 R, 55, 55.2, 242/55.3, 129.5–129.8; 211/99–103, 175, 190, 207; 225/46, 47, 76, 77; 248/251, 274, 295, 297

[56] References Cited

U.S. PATENT DOCUMENTS 1,239,981 9/1917 Storm ..... 242/55.2 X 2,211,576 8/1940 Moore ..... 242/55.2

*Primary Examiner*—Leonard D. Christian

*Attorney, Agent, or Firm*—Smith, Harding, Early & Follmer

[57] ABSTRACT

A reel for ticket rolls is comprised of only five parts excluding conventional fasteners, namely, a base, a pair of guide posts mounted on the base to extend therefrom in spaced parallel relation, and a hub consisting of inner and outer tubes slidably fitted together, which hub is slidably mounted on the pair of guide posts for rotatably supporting a ticket roll.

13 Claims, 5 Drawing Figures

REEL FOR TICKET ROLLS

BACKGROUND AND SUMMARY OF THE INVENTION

This invention relates to reels for ticket rolls of the conventional type in which a web of tickets is wound into a roll on a tubular core. The reel of the invention is of the type for supporting a ticket roll on a counter or wall in a manner such that the tickets may be removed from the end of the ticket web manually by the user. Reels of this type have many applications where a small number of tickets are to be sold. Typical users are clubs, associations or other organizations which do not have a mechanical ticket issuing machine.

It is the general object of the invention to provide a reel for ticket rolls which has a very simple construction resulting in a very low cost of manufacture.

Briefly stated, the general object of the invention is achieved by the provision of a reel which consists of only five parts, excluding conventional fasteners, including a base, a pair of guide posts mounted on the base to extend therefrom in spaced parallel relation, and a hub consisting of a pair of tubes slidably fitted together, the hub being slidably mounted on the guide posts for rotatably supporting a ticket roll.

Another feature of the reel in accordance with the invention is that it is easily adjustable to support ticket rolls of three different widths. By reason of this feature, there is no need for the supplier or user to stock three different sizes of reels.

A further feature of the reel in accordance with the invention is that it is adapted to be used in either a horizontal plane, as on a counter, or a vertical plane, as on a wall.

While there are prior art ticket reels similar to the ticket reel of this invention, the prior art ticket reels cannot achieve all the above-described objects and features of the present invention with a construction having the simplicity of design of the ticket reel of the invention. For example, one prior ticket reel comprises a pair of U-shaped channels mounted in a fixed position to extend perpendicularly from a base for slidably receiving a hub between the side walls of the two channels. However, this ticket reel is not adapted for use on a vertical wall or for use with different width ticket rolls.

DETAILED DESCRIPTION OF THE PREFERRED EMBODIMENT OF THE INVENTION

Figure 1:
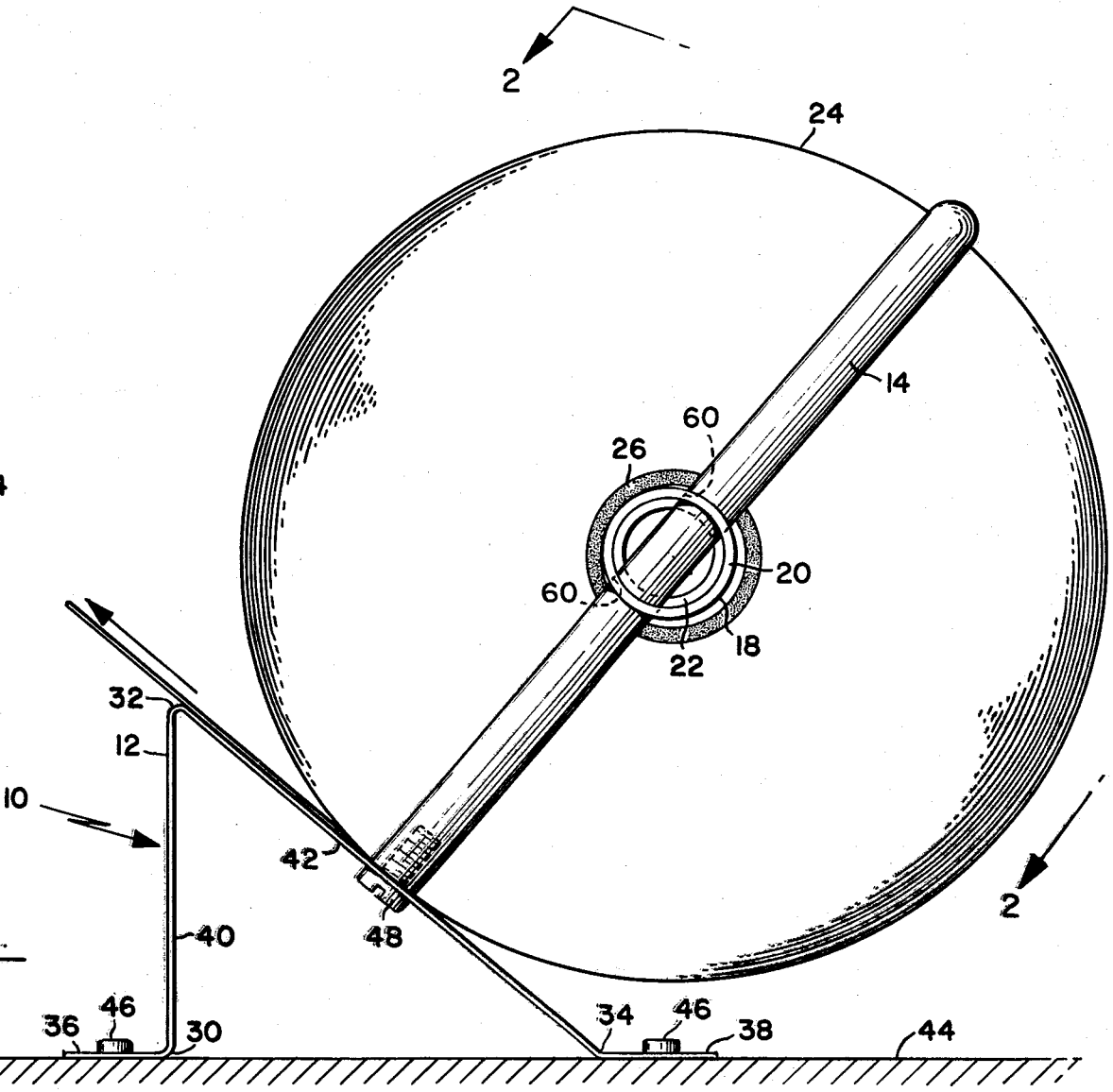
FIG. 1 is a side elevation of a reel in accordance with the invention mounted on a horizontal counter.

In FIG. 1, there is showh a ticket reel 10 comprising except for conventional fasteners, only five parts, namely, a base 12, a pair of guide posts 14 and 16, and a hub 18 including an outer sleeve 20 and an inner sleeve 22. The ticket reel 10 is shown in FIGS. 1 an 2 and rotatably supports a conventional ticket roll 24 comprising a web of perforated tickets wound on a tubular core 26.

The base 12 is made of a thin plate bent into a roll supporting configuration at three bends 30, 32 and 34. By this construction, the base 12 comprises a pair of spaced apart end portions 36 and 38 and an angle shaped medial portion including a pair of leg portions 40 and 42. The bends 30 and 34 are such that the end portions 36 and 38 are arranged to extend in the same plane for mounting against a flat surface such as the counter 44 shown in FIG. 1. The leg portions 40 and 42 extend from the bends 30 and 34, respectively, to join at the bend 32 and form a right triangular configuration with the surface of the counter 44 between bends 30 and 34 as is apparent from a consideration of FIG. 1. Leg portion 40 extends perpendicular to the plane of the end portions 36 and 38 and leg portion 42 extends at an acute angle of about forty degrees with the plane of the end portions 36 and 38 whereby leg portions 40 and 42 join at an included angle of about fifty degrees.

The base 12 is secured to the counter 44 by means of four mounting screws 46. Two of the mounting screws 46 extend through holes in each of the end portions 36 and 38 for engagement with the counter 44 as is shown in FIG. 1.

The guide posts 14 and 16 are elongated, cylindrical members rounded at their free ends and provided with axially extending threaded bores at their other ends whereat they are mounted onto the base 12. The guide posts 14 and 16 are mounted on the leg portion 42 of the base 12 to extend perpendicularly therefrom by means of conventional binder head machine screws 48 which are threadedly engaged with the threaded axial bores in the guide posts 14 and 16. As shown in FIG. 1, the head of each machine screw 48 is on the bottom side of leg portion 42 with the machine screws 48 extending through holes in leg portion 42 for threaded engagement within the threaded axial bores in the guide posts 14 and 16.

The leg portion 42 is provided with six holes 51, 52, 53, 54, 55 and 56, spaced along a line 50 and adapted to permit the machine screws 48 to extend therethrough for engagement with the guide posts 14 and 16. By this arrangement, the guide posts 14 and 16 are removably mounted on the leg portion 44 of the base 12 to be set with three different spacings therebetween to accommodate three different widths of ticket rolls. Typically, the ticket reel 10 is designed to accommodate ticket rolls having widths of one inch, one and a half inches, and two inches.

Figure 2:
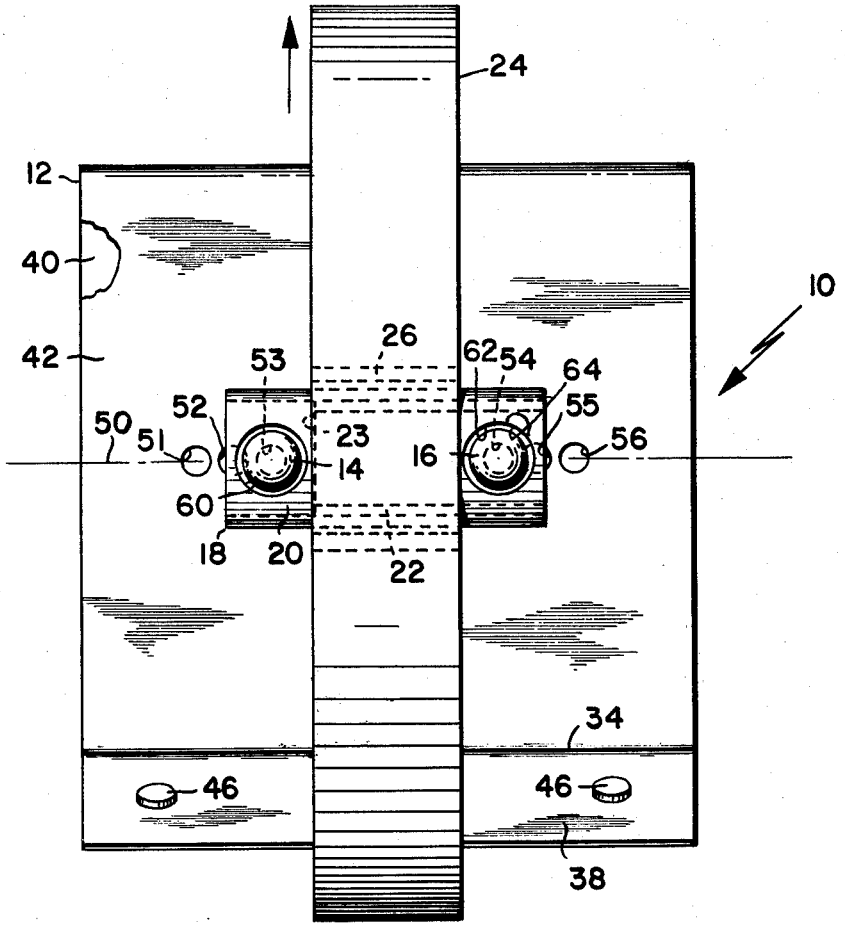
FIG. 2 is a top view taken on line 2—2 of FIG. 1.

In FIG. 2, the ticket reel 10 is shown in a position for supporting a ticket roll 24 of a minimum width, the machine screws 48 extending through the holes 53 and 54 into engagement with the guide posts 14 and 16. By using the holes 52 and 55, the machine screws 48 position the guide posts 14 and 16 in a medium spacing adapted to accommodate a ticket roll of a medium width. By using the holes 51 and 56, the machine screws 48 position the guide posts 14 and 16 at a maximum spacing to accommodate a ticket roll of maximum width.

The hub is adapted to fit loosely within the core 26 of a conventional ticket reel 10 and to be slidably received on the guide posts 14 and 16 in any of the three differently spaced mounting positions of the guide posts 14 and 16. To this end, the hub 18 comprises an outer tube 20 having a first pair of aligned holes 60 near one end thereof, and a second pair of aligned holes 62 near the other end thereof. The holes 60 and 62 are arranged in diametrically opposed portions of the outer tube 20 and to fit slidably onto the guide posts 14 and 16. The holes 60 and 62 are spaced apart a distance equal to the spacing of the holes 53 and 54. The inner tube 22 is provided with a single pair of aligned holes 64 in diametrically opposed portions thereof, the holes 64 being adapted to fit slidably on the guide posts 14 and 16.

It is noted that in the minimum width mounting position, as shown in FIGS. 1 and 2, the guide post 14 extends through the holes 60 of outer tube 20 and the guide post 16 extends through both the holes 62 of outer tube 20 and the holes 64 of the inner tube 22. Thus, the inner tube 22 is completely enclosed within the outer tube 20 as is apparent from FIG. 2. It is noted that in this position the end 23 of inner tube 22 is positioned adjacent to the holes 60 in outer tube 20 and to be clear of the guide post 14 extending through these holes 60.

Figure 3:
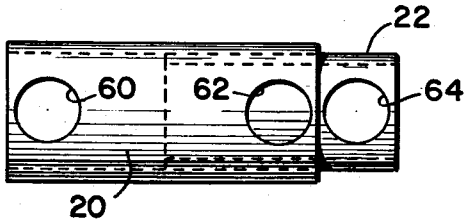
FIGS. 3 and 4 are views of the hub in different operative positions.
Figure 4:
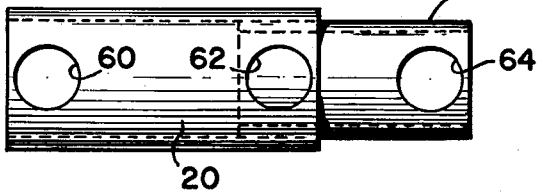

In FIG. 3, the hub 18 is shown with the inner tube 22 extending partially from the outer tube 20 in a position with the holes 64 spaced from the hole 60 a distance equal to the spacing between the holes 52 and 55 in the leg portion 42 of the base 12. In FIG. 4, the inner tube 22 is shown in the fully extended position with the hole 64 spaced from the holes 60 a distance equal to the spacing between the holes 51 and 56. Accordingly, in FIGS. 3 and 4, the hub 18 is shown in the positions to be mounted on guide posts 14 and 16 for accommodating ticket rolls of medium and maximum widths.

In the use of the ticket reel 10 of the invention, the user first determines the width of the ticket roll to be supported on the reel 10. The guide posts 14 and 16 are then set in position on leg portion 42 at the necessary spacing to accommodate the width of the ticket roll selected. This can be in any of the three different positions described above. The base 12 is then mounted on the supporting surface by means of the mounting screws 46. With the ticket reel 10 thus supported, the hub 18 is inserted into the spool of the ticket roll and is mounted on the guide posts 14 and 16 by sliding the hub 18 onto these guide posts which extend through the appropriate holes in the hub 18.

When the ticket reel 10 is mounted on a horizontal counter such as counter 44, the ticket roll 24 will be supported in the position shown in FIG. 1. The user then pulls the ticket web from the bottom of the ticket roll 24 in the direction shown by the arrow in FIG. 1 and removes tickets as desired. If desired, the ticket roll 24 may be supported in the opposite position to that shown in FIG. 1, in which case the user pulls the ticket web from the top of the ticket roll 24.

Figure 5:
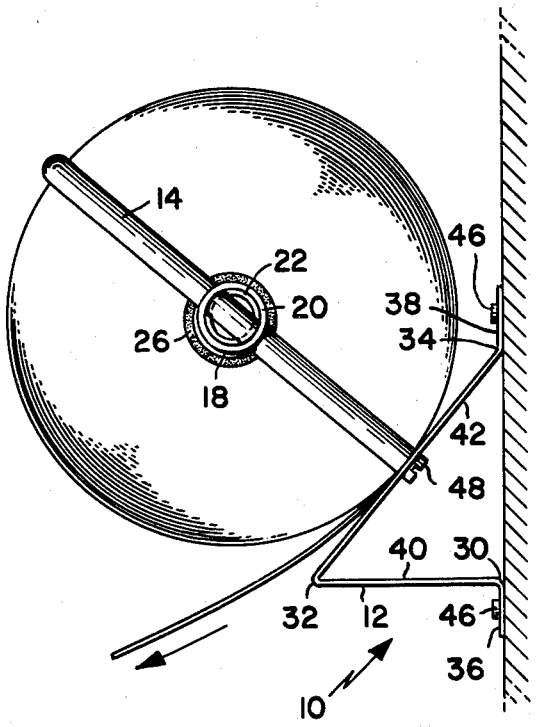
FIG. 5 is a side elevation of the reel in accordance with the invention mounted on a vertical wall.

When the ticket reel 10 is mounted on a vertical wall as is shown in FIG. 5, the ticket roll 24 will assume the position shown in this figure. Again, the user pulls the ticket web from the roll 24 in the direction shown by the arrow in FIG. 2 and tears off tickets as desired.

In both the mounting positions shown in FIGS. 1 and 5, the hub 18 slides downwardly onto the guide posts 14 and 16 until the bottom of the ticket roll 24 contacts the leg portion 42 of the base 12. As the ticket roll is used up, the hub 18 will continue to slide downwardly toward the leg portion 42 by gravity action since the roll 24 will always assume a position in contact with the leg portion 42.

The above-described operation is possible with the ticket reel 10 mounted either on a horizontal counter or on a vertical wall with ticket rolls of three widths by reason of the construction and arrangement of the parts as described above.

I claim:

1. A reel for ticket rolls comprising:

a base, said base being comprised of a thin plate bent into a wall supporting configuration in which said base includes a first portion arranged in a plane for mounting against a flat surface on which the ticket roll is to be supported and an angle shaped portion exending from said first portion, a pair of guide posts, means mounting said pair of guide posts on said angle shaped portion of said base to extend therefrom in spaced parallel relationship, and a hub mounted on said guide posts for supporting a ticket roll between said guide posts, said hub including a pair of axially spaced hole means arranged so that said hub fits over said guide posts with said guide posts extending through said hole means, said hub being retained on said guide posts for slidable movement along the extent of said guide posts.

2. A reel for ticket rolls comprising:

a base, a pair of guide posts, means mounting said pair of guide posts on said base to extend therefrom in spaced parallel relationship, and a hub mounted on said guide posts for supporting a ticket roll between said guide posts, said hub including a pair of axially spaced hole means arranged so that said hub fits over said guide posts with said guide posts extending through said hole means, said hub being retained on said guide posts for slidable movement along the extent of said guide posts, said base being comprised of a thin plate bent into a roll supporting configuration in which said base includes a pair of spaced apart end portions arranged in the same plane for mounting against a flat surface on which the ticket roll is to be supported, and an angle shaped medial portion having a bend whereat a first leg portion extends from one of said end portions to join with a second leg portion extending from the other of said end portions.

3. A reel according to claim 2 wherein said first leg portion extends at an acute angle to the plane of said end portions, and said pair of guide posts are secured to said first leg portion to extend approximately perpendicularly therefrom to contain a ticket roll therebetween.

4. A reel according to claim 3 wherein said second leg portion extends perpendicular to the plane of said end portions.

5. A reel according to claim 3 wherein said first leg portion has a plurality of holes spaced along a line parallel to the axis of said hub, said plurality of holes being adapted to cooperate with the mounting of said pair of guide posts so that said guide posts may be set at a plurality of different spaced positions for accommodating ticket rolls of different widths.

6. A reel according to claim 5 wherein the mounting of said pair of guide posts on said first leg portion is adapted to releasably support said guide posts on said first leg portion so that said guide posts may be set in a plurality of different spaced positions on said first leg portion extending from said holes therein.

7. A reel according to claim 6 wherein said hub comprises an outer tube having a first pair of aligned holes near one end thereof and a second pair of aligned holes near the other end thereof, said pairs of aligned holes being adapted to slidably receive said guide posts, and an inner tube slidably received in said outer tube for axial movement relative thereto, said inner tube having a single pair of aligned holes near one end thereof.

8. A reel according to claim 7 wherein said inner tube is adapted to be positioned in a minimum width position of said hub with said single pair of aligned holes aligned with said first pair of aligned holes of said outer tube, said inner tube having a length such that in said minimum width position of said hub the other end of said inner tube is located adjacent to said second pair of aligned holes of said outer tube.

9. A reel according to claim 8 wherein said inner tube is slidable to a position wherein said single pair of aligned holes of said inner tube are located outside of said outer tube to receive a guide post whereby said hub is adapted to be mounted on guide posts which are adapted to receive a ticket roll which is wider than the ticket roll received in said minimum width position of said hub.

10. A reel for ticket rolls comprising:

a base, a pair of guide posts, means mounting said pair of guide posts on said base to extend therefrom in spaced parallel relationship, and a hub mounted on said guide posts for supporting a ticket roll between said guide posts, said hub including a pair of axially spaced hole means arranged so that said hub fits over said guide posts with said guide posts extending through said hole means, said hub being retained on said guide posts for slidable movement along the extent of said guide posts, said mounting means for said guide posts comprising means for releasably mounting said guide posts on said base at a plurality of different positions wherein said guide posts are spaced apart by different amounts for receiving ticket rolls of different widths between said guide posts.

11. A reel according to claim 10 wherein said hub is arranged to fit over said guide posts at each of said plurality of different positions of said guide posts.

12. A reel for ticket rolls comprising:

a base, a pair of guide posts, means mounting said pair of guide posts on said base to extend therefrom in spaced parallel relationship, and a hub mounted on said guide posts for supporting a ticket roll between said guide posts, said hub including a pair of axially spaced hole means arranged so that said hub fits over said guide posts with said guide posts extending through said hole means, said hub being retained on said guide posts for slidable movement along the extent of said guide posts, said hub comprising an outer tube having a first pair of aligned holes near one end thereof and a second pair of aligned holes near the other end thereof, said pairs of aligned holes being adapted to slidably receive said guide posts, and an inner tube slidably received in said outer tube for axial movement relative thereto, said inner tube having a single pair of aligned holes near one end thereof.

13. A reel according to claim 12 wherein said inner tube is adapted to be positioned in a minimum width position of said hub with said single pair of aligned holes aligned with said first pair of aligned holes of said outer tube, said inner tube having a length such that in said minimum width position of said hub the other end of said inner tube is located adjacent to said second pair of aligned holes of said outer tube.

* * * * *